US005683954A

United States Patent [19]

Sogabe et al.

[11] Patent Number: 5,683,954

[45] Date of Patent: Nov. 4, 1997

[54] IMAGE RECEPTOR FOR TAPE PRINTER

[75] Inventors: Jun Sogabe; Yasuo Tago, both of Osaka, Japan

[73] Assignee: Fujicopian Co., Ltd., Japan

[21] Appl. No.: 448,379

[22] PCT Filed: Oct. 7, 1994

[86] PCT No.: PCT/JP94/01689

§ 371 Date: Jun. 6, 1995

§ 102(e) Date: Jun. 6, 1995

[87] PCT Pub. No.: WO95/10418

PCT Pub. Date: Apr. 20, 1995

[30] Foreign Application Priority Data

Oct. 12, 1993 [JP] Japan ..... 5-254489

[51] Int. Cl.[6] ..... B41M 5/035; B41M 5/38

[52] U.S. Cl. ..... 503/227; 428/195; 428/211; 428/215; 428/216; 428/334; 428/335; 428/336; 428/337; 428/352; 428/354; 428/537.5; 428/913; 428/914

[58] Field of Search ..... 8/471; 428/195, 428/40.1, 913, 914, 352, 354, 211, 213, 215, 216, 332, 334–337, 537.5; 503/227

[56] References Cited

FOREIGN PATENT DOCUMENTS 63-144088 6/1988 Japan ..... 503/227

4-37383 3/1992 Japan ..... 503/227

*Primary Examiner*—Bruce H. Hess

*Attorney, Agent, or Firm*—Fish & Neave

[57] ABSTRACT

An image receptor for a thermal transfer ink for use in a tape printer, which is used with it contained in a cassette in the tape printer, and which comprises an image receptor body (10) and a release material (15) adhered to one side of the image receptor body, and has a total thickness of 80 to 200 μm, characterized in that, when the image receptor is subjected to measurement wherein, with use of a measuring device which comprises a female member (1) having a V-shaped groove (2), and a male member (3) having a V-shaped protrusion (4) capable of engaging with the V-shaped groove (2) and having a radius of rounding of 0.1 to 0.3 mm at the leading edge (5) of the V-shaped protrusion, the image receptor is held between the female member (1) and the male member (3) and a load of 30 to 2,000 g/cm$^2$ is applied thereto for 10 seconds, a lift is not produced in the image receptor at a bending angle β (which means the supplementary angle of the angle α of the V-shaped groove (2) in the female member (1) of the measuring device used) of at least 110 degrees, in order to avoid occurrence of lifts in the image receptor during traveling of the image receptor.

6 Claims, 4 Drawing Sheets

IMAGE RECEPTOR FOR TAPE PRINTER

TECHNICAL FIELD

The present invention relates to an image receptor which is used with the image receptor contained in a cassette in a tape printer.

BACKGROUND ART

The tape printer is provided with simple word processing function and printing function, and is adapted to form printed images (letters, symbols, bar codes, etc.) while unwinding an image receptor in the form of a tape which is wound in a pancake-like shape (a roll-like shape) and to cut off a portion of the image receptor in which the printed images are formed. This cut piece is stuck onto an object as a label. With use of the tape printer it is possible to form a header label, name label, bar code label, and the like, with ease.

A thermal printer is usually employed in the printer part of such tape printer because it can be easily scaled down. Therefore, an ink ribbon to be used therein is usually a thermal transfer ink ribbon.

As the image receptor in the form of a tape for use with such a tape printer, there is known an image receptor of the type which includes an image receptor body comprising a foundation film, such as polyester film, provided on one side thereof with an image-receiving layer such as made of a polyester resin which allows a thermal transfer ink to exhibit good fixing property, and on the other side thereof with a pressure-sensitive adhesive layer, and a release material stacked on the pressure-sensitive adhesive layer of the image receptor body. With this image receptor, a printed image is formed on the image-receiving layer, a desired length of the image receptor including the portion where the printed image is formed is cut off and the release material is then exfoliated from the cut piece, and the remaining image receptor body is stuck at its pressure-sensitive layer side on an object.

FIG. 4 is a plan view showing an example of the tape printer. Note that the word processing function part is not illustrated.

In FIG. 4, numeral 30 denotes a casing of the tape printer. The casing 30 are provided with a thermal head 31, a driving roller 32, a cutter 33 and an outlet for image receptor. A cassette 40 is contained in the casing 30.

An image receptor 20 and a thermal transfer ink ribbon 41, which are each wound in a pancake-like shape, are contained in the cassette 40. The image receptor 20 and the thermal transfer ink ribbon 41 are respectively unwound and fed to between the driving roller 32 and the thermal head 31, where printing is conducted. After printing, the image receptor 20 separated from the ink ribbon 41 is led to the exterior from the image receptor outlet 34. After printing has been conducted on a desired length of the image receptor, it is cut with the cutter 33. The ink ribbon 41 used for printing is wound up on a take-up core 42. Numerals 43 and 44 denote guide rollers for the image receptor 20, and numeral 45 denotes a guide roller for the ink ribbon 41.

However, with use of the conventional tape printer image receptor, there occur frequently a phenomenon that the release material is partially lifted from the image receptor body during traveling in the cassette 40 (hereinafter this phenomenon is simply referred to as "lift"), resulting in such inconveniences that the image receptor does not run smoothly and, in an extreme case, the image receptor carrying printed images does not come out of the tape printer. This lift is due to the bending of the image receptor during travel in the cassette. Further description of these phenomena will be made with reference to the drawings.

FIG. 5 is an explanatory view for illustrating a lift produced in the image receptor. A release material 22 is partially lifted from an image receptor body 21 and, hence, a lift 23 is produced. In an extreme case, the height of the lift 23 (height H from the general surface of the release material, hereinafter the same) reaches up to 1 to 2 mm.

FIG. 6 is an explanatory view for illustrating the traveling state of the image receptor with such a lift produced in the tape printer. There is likely to occur such an inconvenience that the lift 23 is lodged by the outlet 34 if the lift 23 is too large and the image receptor cannot come out of the tape printer.

Even if respective lifts 23 produced are not so large, the following problem will result in some cases. The image receptor 20 is travelled by the rotation of the driving roller 32 as shown in FIG. 6 and is, hence, imposed with a substantial pressure by the rotation of the driving roller 32. This may cause small lifts to move and to join together, thereby forming a large lift which results in the aforesaid inconveniences.

There is a possibility that the occurrence of the aforesaid lift can be prevented if a set value for the peeling strength of the release material from the image receptor body is increased. However, if the peeling strength is increased, the operation of exfoliating the release material is rendered difficult and, hence, it is undesirable to excessively increase the set value for the peeling length.

Further, the present inventors' investigation has revealed that the resistance with respect to the lift cannot be estimated only in terms of the peeling strength, and many factors such as the stiffness (nerve) of the release material and the difference between the stiffness of the image receptor body and that of the release material greatly influence the occurrence of the lift and, hence, it is difficult to completely prevent the occurrence of the lift only by a material design.

The present inventors have investigated to experimentally determine the condition where no lifts are produced and, as a result, developed a measuring device by which the condition can be readily determined, leading to the present invention.

DISCLOSURE OF THE INVENTION

The present invention provides an image receptor for a thermal transfer ink for use in a tape printer, which is used with the image receptor contained in a cassette in the tape printer, and which comprises an image receptor body and a release material adhered to one side of the image receptor body, and has a total thickness of 80 to 200 μm, characterized in that, when the image receptor is subjected to measurement wherein, with use of a measuring device which comprises a female member having a V-shaped groove, and a male member having a V-shaped protrusion capable of engaging with the V-shaped groove and having a radius of rounding of 0.1 to 0.3 mm at the leading edge of the V-shaped protrusion, the image receptor is held between the female member and the male member and a load of 30 to 2,000 g/cm$^2$ is applied thereto for 10 seconds, a lift is not produced in the image receptor at a bending angle of at least 110 degrees.

Herein, the bending angle of the image receptor means the supplementary angle of the angle of the V-shaped groove in the female member of the measuring device used.

BRIEF DESCRIPTION OF THE DRAWINGS

With reference to FIGS. 1 and 2, a measuring device used in the present invention and the manner for use thereof will be explained. FIG. 1 is a perspective view showing an example of the measuring device used in the present invention. FIG. 2 is a view for illustrating the state where the measuring device is used.

In FIGS. 1 and 2, numeral 1 denotes a female member in which a V-shaped groove 2 of an angle α is formed. Numeral 3 denotes a male member in which a V-shaped protrusion 4 of an angle α. The V-shaped protrusion 4 of the male member 3 can perfectly engage with the V-shaped groove 2 of the female member 1. The leading edge 5 of the V-shaped protrusion 4 in the male member 3 is finished to have a radius of rounding of 0.1 to 0.3 mm.

Figure 1:
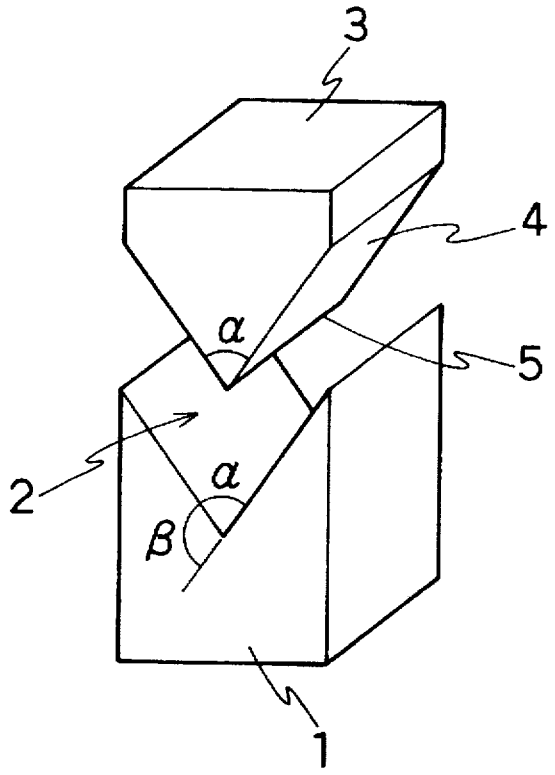
FIG. 1 is a perspective view showing an example of a measuring device for measuring a bending angle used in the present invention.

In measuring, an image receptor 20 is held between the female member 1 and the male member 3 and a given load is applied to the male member 3, thereby pressing the image receptor 20 against the female member 1 for a given period of time. Thereafter the image receptor 20 is taken out and observed to determine whether a lift is produced.

Herein, the supplementary angle β of the angle α of the V-shaped groove 2 in the measuring device used is the bending angle of the image receptor.

In the present invention, it has been found that if no lifts are produced in the image receptor at a bending angle of at least 110 degrees in the above-mentioned measuring device, that is, if no lifts are produced in the image receptor when measured using a measuring device wherein the angle α of the V-shaped groove 2 is not larger than 70 degrees, any lift is not produced in that image receptor even when the image receptor is used in a tape printer with it contained in a cassette.

Even when an image receptor is statically bent in the same state as the bending state which the image receptor undergoes during the traveling in a cassette, usually no lifts are not produced and, hence, it is impossible to estimate the resistance with respect to the lift during the traveling in the cassette. For this reason, in the present invention, a test is carried out under more severe conditions (the bending angle β is not smaller than 110 degrees, and the radius of rounding at the bending portion (the leading edge 5 of the V-shaped protrusion 4) is 0.1 to 0.3 mm) to estimate the resistance with respect to the lift.

In the present invention, the measurement is preferably performed under the following conditions to obtain results with good reproducibility.

(1) Bending angle β: not smaller than 110 degrees

Usually, a reliable result is obtained when measured at a bending angle β of 110 degrees. However when a more reliable result is desired, or when the image receptor is used in a tape printer wherein the traveling condition is more severe, a bending angle β which is larger than 110 degrees, for example, 150 degrees is adopted.

Usually the preparation of two types of measuring devices, one wherein the bending angle β is 110 degrees [the angle α of the V-shaped groove (the V-shaped protrusion) is 70 degrees] and the other wherein the bending angle β is 150 degrees [the angle α of the V-shaped groove (the V-shaped protrusion) is 30 degrees], can comply with all cases.

(2) Radius of rounding at the leading edge 5 of the protrusion 4:0.1 to 0.3 mm

When the radius of rounding is smaller than 0.1 mm, the image receptor suffers flaws due to fracture, resulting in a reduced reliability. When the radius of rounding is larger than 0.3 mm, the bending condition is too mild, resulting in a reduced reliability.

(3) Load: 30 to 2,000 g/cm$^2$

When the load is smaller than 30 g/cm$^2$, the image receptor cannot be bent to make a desired angle. When the load is larger than 2,000 g/cm$^2$, the image receptor is deformed or collapsed. In view of the reliability, the preferred load is within the range of 50 to 200 g/cm$^2$. Usually a load of 100 g/cm$^2$ is adopted. Herein, the load means the sum of an external load and the weight of the male member 3.

(4) Load-holding time: 10 seconds (5) Measuring temperature: 25° C.±2° C.

(6) Method for determining whether a lift is produced

Presence of lift: a gap is visually observed between the image receptor body and the release material.

Absence of lift: no gap is visually observed between the image receptor body and the release material.

The measuring device used in the present invention is usually made of a metal such as aluminum alloy. However, it may be made of a hard plastics.

The image receptor of the present invention is not particularly limited with respect to the structure thereof, so long as the image receptor comprises an image receptor body and a release material adhered to one side of the image receptor body, and has a total thickness of 80 to 200 μm, wherein the bending angle β measured with the aforesaid measuring device under the aforesaid conditions and at which no lifts are produced is not smaller than 110 degrees.

With referring to the drawings, typical examples of the image receptor of the present invention will be explained.

Figure 3:
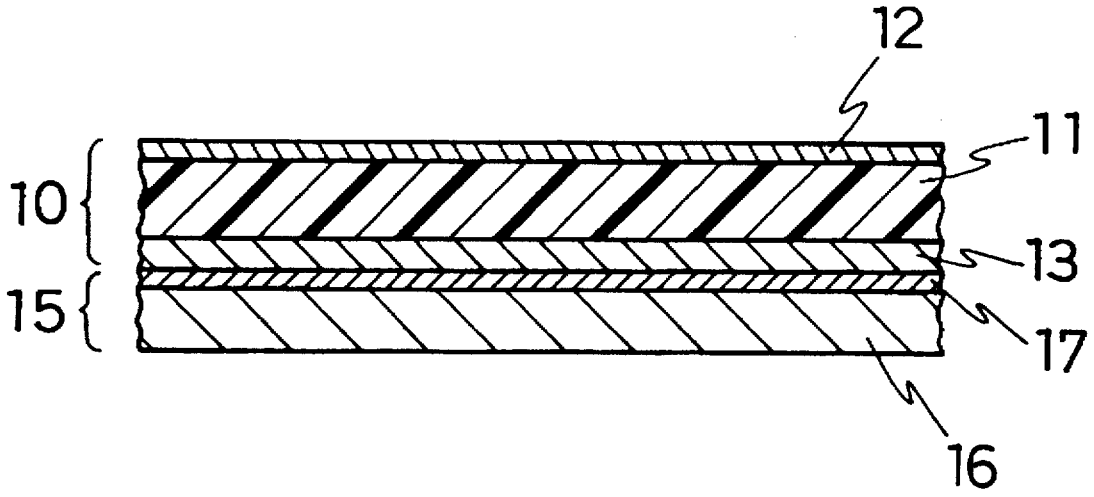
FIG. 3 is a partial sectional view showing an example of the image receptor of the present invention.
Figure 4:
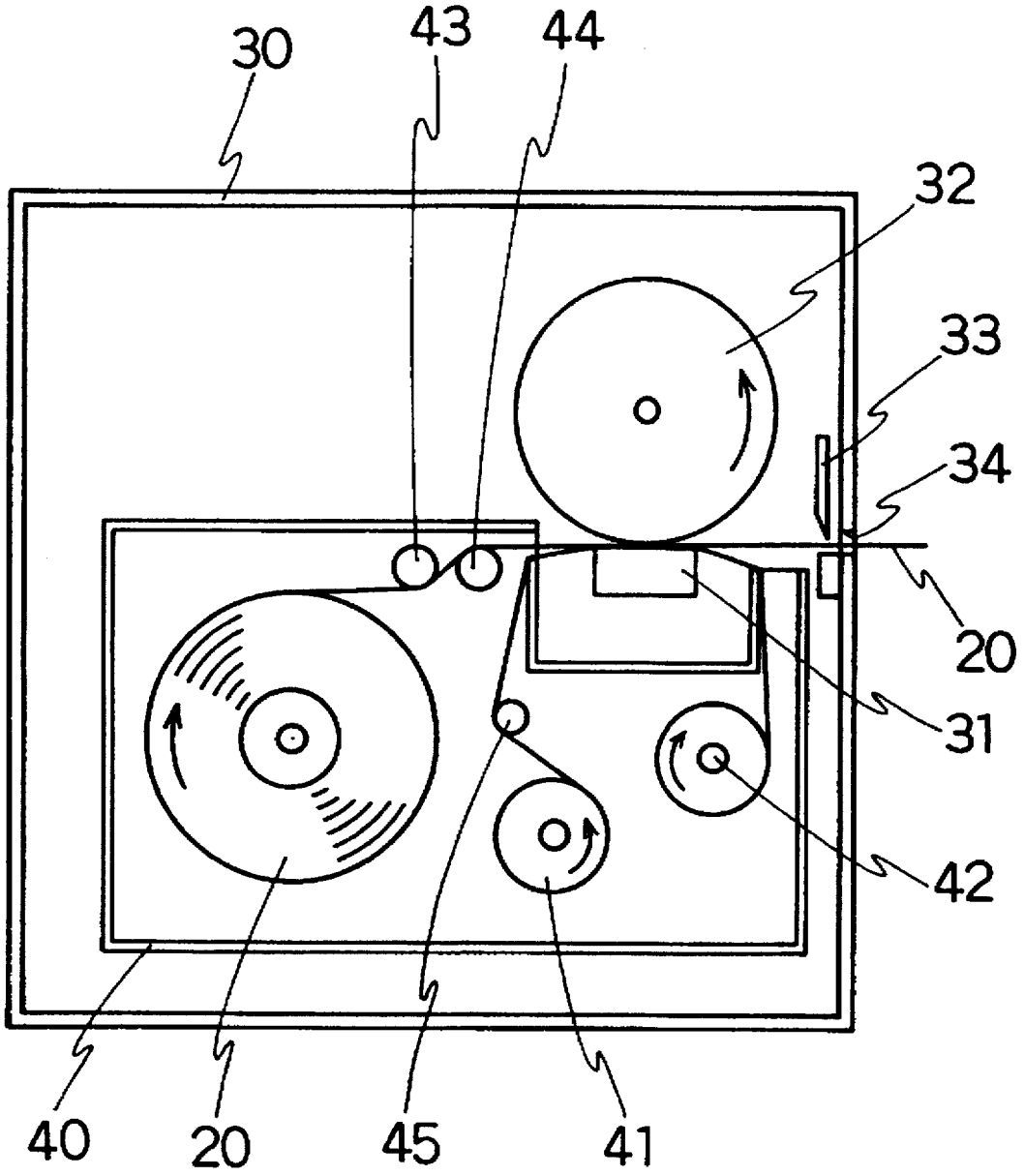
FIG. 4 is a plan view showing an example of a tape printer.
Figure 5:
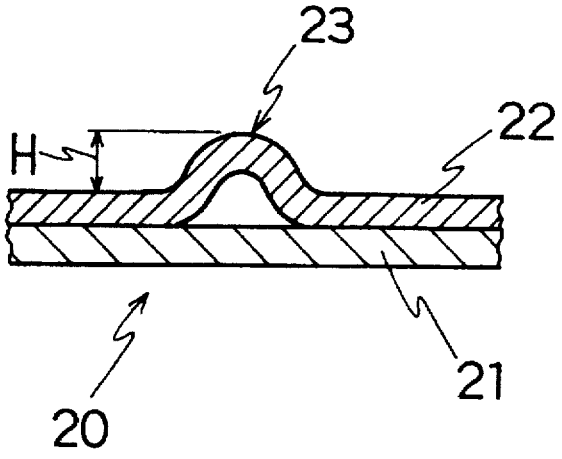
FIG. 5 is an explanatory view for illustrating a lift of a release layer in an image receptor.
Figure 6:
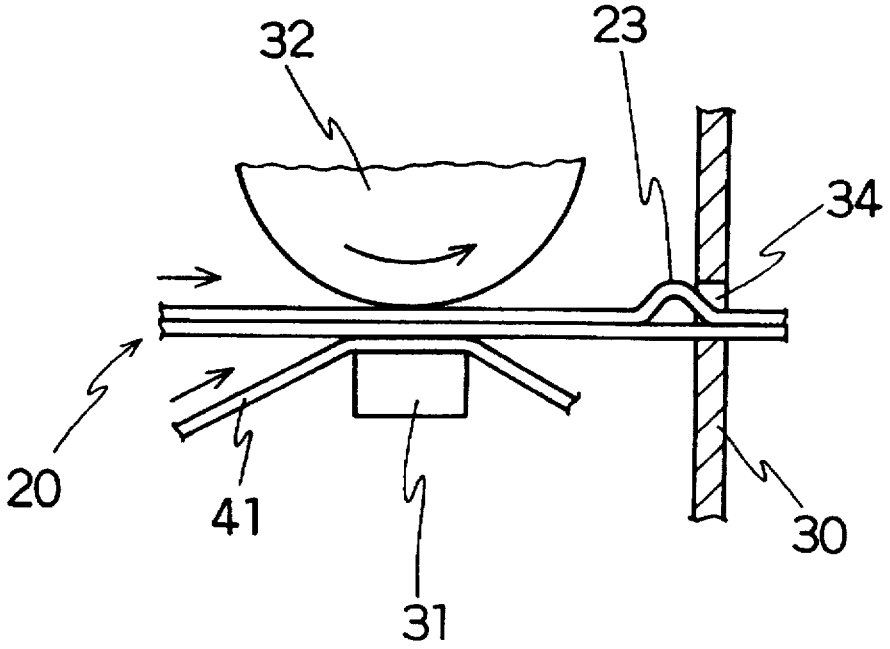
FIG. 6 is an explanatory view for illustrating the traveling state of an image receptor with a lift produced in a tape printer.

FIG. 3 is a partial sectional view showing an Example of the image receptor of the present invention. The image receptor of this example comprises an image receptor body 10, and a release material 15 adhered to one side of the image receptor body 10.

The image receptor body 10 comprises a foundation film 11 which is provided on one side thereof with an image-receiving layer 12 and on the other side thereof with a pressure-sensitive adhesive layer 13. The release material 15 comprises a base member 16, on one side of which a release layer 17 is formed. The release material 15 is removably adhered to the pressure-sensitive adhesive layer 13 of the body 10 on the side of the release layer 17.

Usable as the base member 16 of the release material 15 are papers, plastic films, and the like.

Hereinafter, the release material using a paper as the base member 16 is referred to as "embodiment 1", and the release material using a plastic film as the base member 16 is referred to as "embodiment 2".

In embodiment 1, papers having a density of not higher than 1.0 g/cm$^3$ are preferably used as the base member 16.

When a paper having a density of higher than 1.0 g/cm$^3$ is used, a lift is prone to undesirably occur when the resulting image receptor is stored under high-temperature and high-humidity conditions. An image receptor in which the release material uses as the base member a paper having a density of not higher than 1.0 g/cm$^3$ is free from lifts of the release material even when stored under high-temperature and high-humidity conditions. This is conceivably because such a low-density paper is not so densely stuffed with fibers and, hence, absorbs expansion of itself due to moisture absorption. From this point of view, glassine paper having a density as high as 1.1 to 1.2 g/cm$^3$ is not suitable because it is incapable of absorbing expansion of itself, which causes lifts of a release material using glassine paper. If the density of a paper used is too low, satisfactory stiffness cannot be expected, which results in poor operability in exfoliating the release material from the image receptor body. It is, therefore, preferable that the paper has a density of not lower than 0.7 g/cm$^3$.

Examples of papers include woodfree paper, kraft paper, simili paper, paper for copying, and india paper. Synthetic paper is also utilizable. The thickness of the paper is preferably from 40 to 90 mm. If the thickness of the paper is larger than that range, the winding length of the image receptor (which means the length of the image receptor accommodatable in a tape printer) becomes short, whereas if it is smaller than the range, satisfactory stiffness cannot be expected, degrading the operability for exfoliation.

In embodiment 1, preferable is a release material comprising the aforesaid paper base member, a resinous layer provided on the surface of the base member and a release layer provided on the resinous layer.

Particularly preferable is a release material comprising the aforesaid paper base member, a laminated layer formed on the surface of the base member and composed of at least one resin selected from the group consisting of polyolefin resins, polystyrene resins, polyester resins and polyurethane resins, and a release layer provided on the laminated layer (hereinafter referred to as "embodiment 1a").

With the release material of embodiment 1a, the presence of the laminated resin layer will suppress expansion of the paper base member and, hence, prevent the production of lifts during storage almost completely.

Examples of the polyolefin resins for the laminated layer include polyethylene resins, polypropylene resins, ethylene-vinyl acetate copolymers, ethylene-ethyl acrylate copolymers, ethylene-methyl methacrylate copolymers, ethylene-acrylic acid copolymers, and ethylene-vinyl alcohol copolymers. The laminated resin layer is preferably 5 to 25 μm thick. With the laminated layer of a thickness smaller than that range, it is difficult to sufficiently suppress expansion of the paper base member. With the laminated layer of a thickness larger than the range, on the other hand, the winding length of the image receptor is shortened undesirably. As the lamination method, any known method can be employed, but usually employed is an extrusion laminating method.

The releasing agent for the release layer is not particularly limited. Although there can be used various releasing agents such as silicone resin type, olefin resin type, long-chain-alkyl-containing polymer type and fluorine-containing resin type, usually silicone resin type releasing agents are preferably used. The release layer is usually about 0.1 to about 2 μm thick.

In embodiment 1, there can be advantageously used an alternative release material comprising the aforesaid paper base member, a resin coat layer formed on the surface of the base member, and a release layer provided on the resin coat layer (hereinafter referred to as "embodiment 1b").

In embodiment 1b, the presence of the resin coat layer can also suppress expansion of the paper base member.

As the resin for use in the resin coat layer, there can be used, without particular limitations, nonhygroscopic resins or resins which will not expand even when they absorb moisture. Examples of such resins include polyacrylic alkyl esters, polymethacrylic alkyl esters, polyacrylamide, polystyrene, polyvinyl butyral, polyvinyl acetate, polyvinyl chloride, polyvinylidene chloride, polyurethanes, polyesters, carboxymethyl cellulose, urea resins, and melamine resins. These resins may be used either alone or as a mixture. The resin coat layer is suitably 0.5 to 25 μm thick. If the thickness of the resin coat layer is smaller than that range, expansion of the paper base member cannot be suppressed sufficiently, while if it exceeds the range, the winding length of the image receptor becomes undesirably short.

In embodiment 1b, there can be used a release layer of the same type as that in embodiment 1a.

Then the release material for use in embodiment 2 will be explained.

Preferably usable as the plastic film for the base member are polyester films and polyolefin films.

Examples of the polyester films are films of polyethylene terephthalate, polybutylene terephthalate and polyethylene naphthalate or the like. Examples of the polyolefin film are films of polyethylene, polypropylene or the like. These films may be unstretched films or unior or biaxially stretched films. The film base member is suitably about 15 to about 100 μm thick. If the thickness of the film base member is smaller than that range, the operability for exfoliation is degraded, while on the other hand if it exceeds the range, the winding length becomes undesirably short.

In embodiment 2, a release layer is directly formed on one side of the film base member. As the release layer, there can be used a release layer of the same type as that embodiment 1.

In either the aforesaid embodiment 1 or embodiment 2, the release material is preferably 50 to 100 μm thick so as to assure a large winding length and high operability for exfoliation. The peel strength of the release material from the image receptor body is preferably about 2 to about 10 g/20 mm (at a peeling rate of 0.15 m/min) so as to assure good operability for exfoliation.

Then, the image receptor body in the present invention will be explained. The image receptor body 10 may be of any constitution, provided that it comprises a foundation film 11, an image-receiving layer 12 composed of a resin having good fixing property for a thermal transfer ink and provided on one side of the foundation film, and a pressure-sensitive adhesive layer 13 provided on the other side of the foundation film.

Preferably usable as the foundation film for the image receptor body are, for example, polyester films such as a polyethylene terephthalate film, in view of their strength and good adhesiveness with the image-receiving layer. Besides, usable therefor are a polyvinyl chloride film, polycarbonate film, triacetyl cellulose film, polyamide film, polyimide film, aramid film, and a like film. The foundation film is preferably about 20 to about 60 μm thick, in view of the handling property in sticking to an object or in a like operation.

As the resin for the image-receiving layer, a polyester resin is advantageously used, but another resin is usable depending upon the kind of the vehicle of the thermal transfer ink. The image-receiving layer may be incorporated with a small amount of an extender such as silica or titanium oxide. The amount of the image-receiving layer to be applied is usually about 0.08 to about 2 g/m$^2$. The amount thereof in excess of that range will degrade the anti-blocking property, whereas the amount thereof smaller than the range results in a printed image with poor fixing property.

When a printed image with good fixing property can be formed without the image-receiving layer depending upon the kind of a combination of the resin for the foundation film and the vehicle of the thermal transfer ink, the image-receiving layer may not be provided.

On the foundation at the side opposite to the side formed with the image-receiving layer, a color coat layer may be provided as required. Otherwise, a colored foundation may be used instead of the provision of such a color coat layer.

The pressure-sensitive adhesive layer is formed on the foundation at the side opposite to the side formed with the image-receiving layer. The pressure-sensitive adhesive layer can be formed of any conventional pressure-sensitive adhesive, such as an acrylic resin-type pressure-sensitive adhesive, without particular limitations. Note that it is preferable to select the pressure-sensitive adhesive layer of the image receptor body and the release layer of the release material so that the peel strength therebetween would be within the aforesaid range. The pressure-sensitive adhesive layer is preferably about 5 to about 40 μm thick.

The thickness of the image receptor body is preferably from 30 to 100 μm in view of assuring a large winding length, an easy operation for exfoliating the release material, and an easy operation for sticking to an object.

The image receptor of the present invention is preferably 80 to 200 μm thick as the total thickness. An image receptor having a thickness of smaller than 80 μm is poor in handling property. When the thickness is larger than 200 μm, the winding length becomes short.

BEST MODE FOR CARRYING OUT THE INVENTION

The present invention will be explained by means of Examples and Comparative Example.

EXAMPLES 1 TO 4 AND COMPARATIVE EXAMPLE

On one side of a 38 μm-thick polyethylene terephthalate film was applied a 5% by weight solution prepared by dissolving a polyester resin (UE-3210 made by UNITIKA Ltd., glass transition point: 45° C., molecular weight: 20,000) in a toluene-methyl ethyl ketone mixed solvent (2:3 in weight ratio) in a coating amount when being dried of 0.2 g/m$^2$, followed by drying to form an image-receiving layer. On the film at the side opposite to the side formed with the image-receiving layer was formed a 15 μm-thick pressure-sensitive adhesive layer of an acrylic resin type. Thus, an image receptor body was given.

Onto the pressure-sensitive adhesive layer of the image receptor body was stuck each of the following release materials so that the release layer of the release material would be brought into contact with the adhesive layer, thus obtaining an image receptor.

(Release material in Example 1)

Onto one side of a 60 μm-thick woodfree paper sheet (density: 0.85 g/cm$^3$) was extrusion-laminated a 15 μm-thick polyethylene film, on which a 0.5 μm-thick release layer of a silicone resin was then formed.

(Release material in Example 2)

In the release material of Example 1, a 70 μm-thick kraft paper sheet (density: 0.8 g/cm$^3$) was used instead of the woodfree paper.

(Release material in Example 3)

On one side of a 60 μm-thick woodfree paper sheet (density: 0.85 g/cm$^3$) was formed a 8 μm-thick coat layer of methyl acrylate resin, on which a 0.5 μm-thick release layer of a silicone resin was then formed.

(Release material in Example 4)

On one side of a 50 μm-thick, biaxial-stretched polypropylene film was formed a 0.7 μm-thick release layer of a silicone resin.

(Release material in Comparative Example)

In the release material of Example 1, a 70 μm-thick glassine paper (density: 1.2 g/cm$^3$ ) was used instead of the woodfree paper.

Each of the image receptors thus fabricated was slitted into strips each having a 18 mm-width, and a 20 cm-long test piece was cut out from the strip.

Figure 2:
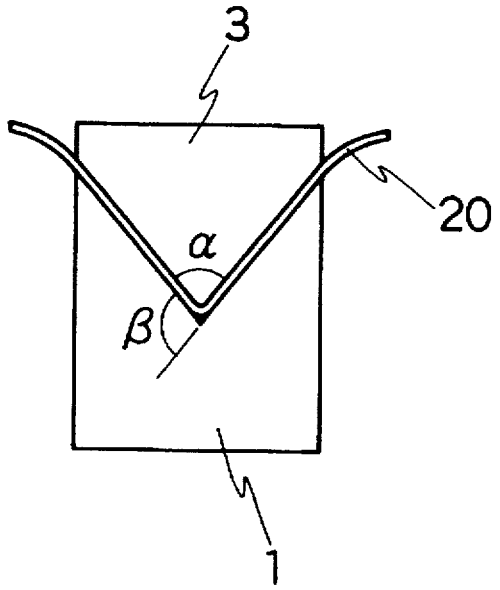
FIG. 2 is an explanatory view showing the state where the measuring device is used.

With use of the measuring device (made of an aluminum alloy) shown in FIGS. 1 and 2, the test piece was subjected to the bending test under the below-mentioned conditions.

Test conditions (1) Bending angle β: 110 degrees (2) Radius of rounding at the leading edge 5 of the protrusion 4: 0.2 mm (3) Load: 100 g/cm$^2$ (4) Load-holding time: 10 seconds (5) Measuring temperature: 25° C.±2° C.

With the image receptors of Examples 1 to 4, any lift was not produced, whereas with the image receptor of Comparative Example, a lift was produced.

Each of the aforesaid image receptors was wound around a core while being slitted to have a width of 18 mm, to form a pancake-like image receptor (winding length: 8 m).

The pancake-like image receptor was contained in a cassette for a commercially available tape printer (Name Land made by Casio Computer Co., Ltd. ), and continuous printing was conducted using the overall winding length.

With the image receptors of Examples 1 to 4, no lifts occurred, whereas with the image receptor of Comparative Example, lifts occurred.

As have described above, with the tape printer image receptor wherein the bending angle which is measured with the measuring device provided in the present invention and at which no lifts are produced is at least 110 degrees, lifts do not occur during traveling in the tape printer and, hence, there do not occur such inconveniences that the image receptor does not run smoothly and that the image receptor in which printed images are formed cannot come out of the tape printer.

We claim:

1. An image receptor for a thermal transfer ink for use in a tape printer, which is used with the image receptor contained in a cassette in the tape printer, the image receptor comprising an image receptor body and a release material, the image receptor having a total thickness of 80 to 200 μm, the image receptor body comprising a foundation film, an image-receiving layer provided on one side of the foundation film and a pressure-sensitive adhesive layer provided on the other side of the foundation film, the release material comprising a base member and a release layer provided on one side of the base member, the base member comprising a paper sheet or plastic film, the release material being removably adhered to the pressure-sensitive adhesive layer of the image receptor body on the side of the release layer, wherein, when the image receptor is subjected to measurement by a measuring device which comprises a female member having a V-shaped groove, and a male member having a V-shaped protrusion capable of engaging with the V-shaped groove and having a radius of rounding of 0.1 to 0.3 mm at the leading edge of the V-shaped protrusion, wherein the image receptor is held between the female member and the male member and a load of 30 to 2,000 g/cm$^2$ is applied thereto for 10 seconds, a lift in the image receptor is not produced at a bending angle of at least 110 degrees.

2. The image receptor for a tape printer of claim 1, wherein the base member of the release material is a paper sheet having a density not higher than 1.0 g/cm$^3$.

3. The image receptor for a tape printer of claim 2, wherein a resinous layer is provided between the paper sheet and the release layer.

4. The image receptor for a tape printer of claim 1, wherein the base member of the release material is a plastic film having a thickness of from about 15 to about 100 μm.

5. The image receptor for a tape printer of claim 1, wherein the thickness of the image receptor body is from 30 to 100 μm, and the thickness of the release material is from 50 to 100 μm.

6. The image receptor for a tape printer of claim 1, wherein the peel strength of the release material from the image receptor body is from about 2 to about 10 g/20 mm at a peeling rate of 0.15 m/min.

* * * * *